US008690525B2

(12) United States Patent
Ohtachi et al.

(10) Patent No.: US 8,690,525 B2
(45) Date of Patent: Apr. 8, 2014

(54) VACUUM PUMP

(75) Inventors: Yoshinobu Ohtachi, Funabashi (JP); Manabu Nonaka, Chiba (JP); Yasushi Maejima, Katsushika-ku (JP)

(73) Assignee: Edwards Japan Limited, Chiba (JP)

( * ) Notice: Subject to any disclaimer, the term of this patent is extended or adjusted under 35 U.S.C. 154(b) by 574 days.

(21) Appl. No.: 12/999,137

(22) PCT Filed: Jul. 14, 2009

(86) PCT No.: PCT/JP2009/062708
§ 371 (c)(1),
(2), (4) Date: Dec. 15, 2010

(87) PCT Pub. No.: WO2010/007975
PCT Pub. Date: Jan. 21, 2010

(65) Prior Publication Data

US 2011/0103934 A1 May 5, 2011

(30) Foreign Application Priority Data

Jul. 14, 2008 (JP) ..... 2008-182364
Jul. 14, 2008 (JP) ..... 2008-182365

(51) Int. Cl.
*F04D 29/00* (2006.01)

(52) U.S. Cl.
USPC ..... 415/119; 415/118

(58) Field of Classification Search
USPC ..... 415/13, 14, 118, 119; 417/63, 423.4
See application file for complete search history.

(56) References Cited

U.S. PATENT DOCUMENTS

| | | | | |
|---|---|---|---|---|
| 4,822,251 | A * | 4/1989 | Amrath et al. | 417/63 |
| 5,469,007 | A * | 11/1995 | Toyama | 310/90.5 |
| 6,213,737 | B1 * | 4/2001 | Murakami et al. | 417/423.4 |
| 6,709,226 | B2 * | 3/2004 | Maejima et al. | 415/9 |
| 7,539,549 | B1 * | 5/2009 | Discenzo et al. | 700/28 |
| 2009/0317261 | A1 * | 12/2009 | Bruce | 417/32 |
| 2010/0054957 | A1 * | 3/2010 | Goetze et al. | 417/53 |

FOREIGN PATENT DOCUMENTS

| | | | |
|---|---|---|---|
| JP | 06101655 | A | 4/1994 |
| JP | 06330885 | A | 11/1994 |
| JP | 6330885 | A | 11/1994 |
| JP | 2003097554 | A | 4/2003 |
| JP | 2004117091 | A | 4/2004 |
| JP | 2004150340 | A | 5/2004 |

OTHER PUBLICATIONS

International Search Report dated Sep. 1, 2009 for corresponding PCT Application No. PCT/JP2009/062708, file Jul. 14, 2009.

* cited by examiner

*Primary Examiner* — Edward Look
*Assistant Examiner* — Liam McDowell
(74) *Attorney, Agent, or Firm* — Westman, Champlin & Koehler, P.A.

(57) ABSTRACT

A vacuum pump includes a casing having an inlet port and an outlet port, a stator portion provided inside the casing and a rotor portion having a shaft rotatably supported inside the casing and a rotor disposed on the shaft and provided with a gas transfer mechanism that transfers a gas from the inlet port to the outlet port. The rotor portion is arranged with a predetermined clearance between the rotor portion and the stator portion. A motor rotates the shaft. Vibration detection disposed in the stator portion detects vibrations by converting vibration amplitude to an electric signal. Contact detection judges an occurrence of contact between the stator portion and the rotor portion when, in the vibration detected by the vibration detection, an amplitude in frequency of a specific vibration caused by contact between the stator portion and the rotor portion exceeds a predetermined threshold value.

15 Claims, 7 Drawing Sheets

(a)

(b)

(c)

VACUUM PUMP

BACKGROUND OF THE INVENTION

1. Field of the Invention

The present invention relates to a vacuum pump, for instance a turbo-molecular pump, that evacuates a vacuum vessel.

2. Description of the Related Art

In vacuum pumps such as turbo-molecular pumps or the like, there is a very small clearance between a stator portion and a rotor portion in which rotating blades or the like rotate at high speed. As a result, contact between the rotor portion and the stator portion occurs in case that, for instance, solid products such as aggregates in the evacuated gas become deposited on the vacuum pump, or when a rotary body deforms due to creep, or in case of advanced wear of protective bearings.

Serious problems can ensue if such state of contact between the rotor portion and the stator portion is not addressed through maintenance (overhaul).

Maintenance periods have been conventionally anticipated in accordance with techniques set forth in, for instance, Japanese Patent Application Laid-open Nos. H6-330885, H6-101655 and 2004-117091. Reaching a stage by which the vacuum pump is no longer re-useable has been averted conventionally through prompting the execution of maintenance at appropriate periods.

Japanese Patent Application Laid-open No. H6-330885 proposes the features of detecting the runout amount of a rotor using a position sensor, and issuing an alarm and stopping a pump, when the detected runout amount exceeds a reference runout amount.

Japanese Patent Application Laid-open No. H6-101655 discloses the feature of directly measuring the amount of deposited solid product (foreign matter) using a capacitive-type membrane pressure sensor.

Japanese Patent Application Laid-open No. 2004-117091 discloses the feature of measuring a temperature difference between the temperature of a gas flow path and the temperature of a portion that is not a gas flow path, and measuring the amount of solid product deposited in the gas flow path on the basis of the temperature difference.

In the technique set forth in Japanese Patent Application Laid-open No. H6-330885, however, it was not possible to discriminate between an increase in vibration amplitude caused by growing unbalance of a rotary body over time, and an increase in vibration amplitude caused by physical contact between a rotor portion and a stator portion.

Also, it was not possible to distinguish between an increase in vibration amplitude caused by mechanical vibration in response to, for instance, opening and closing of a vacuum valve to which a pump is connected, or caused by external vibration applied to a device (vacuum vessel or the like) to which the pump is connected, and an increase in vibration amplitude caused by physical contact between a rotor portion and a stator portion.

Thus, it is a first object of the present invention to provide a vacuum pump where physical contact between a rotor portion and a stator portion can be detected with good precision.

SUMMARY OF THE INVENTION

In the techniques set forth in Japanese Patent Application Laid-open Nos. H6-101655 and 2004-117091, it was difficult to sense, accurately and with good precision, the occurrence whereby the amount of solid product deposit reached a clearance between a rotor portion and a stator portion, due to the influence of measurement error.

Thus, it is a second object of the present invention to allow detecting, with good precision, the occurrence whereby the amount of solid product deposit reaches a clearance between a rotor portion and a stator portion.

In order to attain the above-mentioned first object, an embodiment of the invention provides a vacuum pump that has an casing provided with an inlet port and an outlet port; a stator portion provided inside the casing; a rotor portion having a shaft rotatably supported inside the casing, and a rotor disposed on the shaft and provided with a gas transfer mechanism that transfers a gas from the inlet port to the outlet port, the rotor portion being arranged with a predetermined clearance between the rotor portion and the stator portion; a motor rotating the shaft; vibration detection means for detecting vibration; and contact detection means for detecting an occurrence of contact between the stator portion and the rotor portion when, in the vibration detected by the vibration detection means, a specific vibration caused by contact between the stator portion and the rotor portion exceeds a predetermined threshold value.

In some embodiments, the specific vibration is a vibration of at least one frequency from among: a first frequency that denotes a natural frequency of a part configuring the stator portion; a second frequency that denotes a natural frequency of a part configuring the rotor portion; a third frequency that denotes a frequency that is a multiple of revolutions (frequency) of the rotor portion; a fourth frequency that denotes a beat frequency of vibrations of the first to third frequencies; and a fifth frequency, of a specific range, generated upon contact between the rotor portion and the stator portion.

In some embodiments, the vibration detection means is formed of a vibration sensor disposed in the stator portion, on a member that opposes the rotor portion.

In some embodiments, the vibration detection means is formed of a plurality of vibration sensors disposed at different location of the stator portion, and detects the occurrence of contact between the stator portion and the rotor portion on the basis of differences in the vibrations detected by the vibration sensors.

In some embodiments, the stator portion at which the vibration detection means is provided is fixed to the casing through an elastic member.

In some embodiments, the vibration detection means detects, as vibration, a change over time of a positional displacement of the rotor portion.

In some embodiments, the vibration detection means is formed of a contact-less displacement sensor that detects a displacement of the rotor portion.

In some embodiments, the vacuum pump also includes alarm output means for emitting an alarm for urging execution of maintenance when the contact detection means detects occurrence of contact between the stator portion and the rotor portion.

In order to attain the above-mentioned second object, some embodiments provide a vacuum pump that has an casing provided with an inlet port and an outlet port; a stator portion provided inside the casing; a rotor portion having a shaft rotatably supported inside the casing, and a rotor disposed on the shaft and provided with a gas transfer mechanism that transfers a gas from the inlet port to the outlet port, the rotor portion being arranged with a predetermined clearance between the rotor portion and the stator portion; a motor rotating the shaft; an elastic member having a vibration damping characteristic, disposed between the casing and the stator portion; vibration detection means disposed on the stator portion; a filter to which an output of the vibration detection means is inputted, and having, as a pass band, a frequency band higher than a cutoff frequency of the vibration damping characteristic of the elastic member; and contact detection means for detecting an occurrence of contact between the stator portion and the rotor portion when an output of the filter exceeds a predetermined threshold value.

In some embodiments, the vacuum pump is a composite-type vacuum pump comprising a turbo-molecular pump section and a thread groove pump section, and the vibration detection means is disposed on a thread groove spacer that forms an evacuation flow path of the thread groove pump section.

Some embodiments further comprise sensitivity adjustment means, provided on or inside the casing, for adjusting the sensitivity of the vibration detection means.

Some embodiments further comprise storage means, provided on or inside the casing, for storing a correction value of an output level of the vibration detection means.

In some embodiments, the elastic member is formed of material used for the O-ring, or formed of an O-ring that is continuous in a circumferential direction.

In some embodiments, the vibration detection means outputs a digital signal to which a vibration detection value is converted, and the filter is formed of a digital filter.

Some embodiments further comprise an alarm output means for emitting an alarm, or a contact notification signal, urging execution of maintenance when the contact detection means detects occurrence of contact between the stator portion and the rotor portion.

The present invention allows detecting, with good precision, physical contact between a rotor portion and a stator portion through detecting the occurrence of contact between the rotor portion and the stator portion when a specific vibration caused by contact between the rotor portion and the stator portion exceeds a predetermined threshold value.

Further, the present invention allows reducing the influence, exerted on the contact detection means, of resonance generated upon acceleration or deceleration of the rotor portion, and the influence of vibration and shocks that propagate from outside the vacuum pump, by arranging an elastic body between the casing and the stator portion, and by causing the output of the vibration detection means disposed at the stator portion to pass through a high-pass filter. As a result, it becomes possible to sense, with yet better precision, contact between the rotor portion and the stator portion that occurs as the amount of deposited solid product reaches the clearance between the rotor portion and the stator portion.

BRIEF DESCRIPTION OF THE DRAWINGS

FIG. 2 is a diagram illustrating a configuration example of another detection means in a contact detection means according to Embodiment 1, wherein FIG. 2A is a diagram illustrating an arrangement example in which two vibration sensors are used, FIG. 2B is a diagram illustrating another arrangement example of the vibration sensors, and FIG. 2C is a diagram illustrating an arrangement example of a vibration sensor that utilizes a vibration damping member;

DESCRIPTION OF THE PREFERRED EMBODIMENTS

Preferred embodiments of the present invention are explained below with reference to FIGS. 1 to 7.

(1) Overview of the Embodiments

In Embodiment 1 and Embodiment 2, an example of a vacuum pump having a function of detecting contact between a rotor portion and a stator portion will be explained on the basis of a turbo-molecular pump.

(2) Details of the Embodiments

Figure 1:
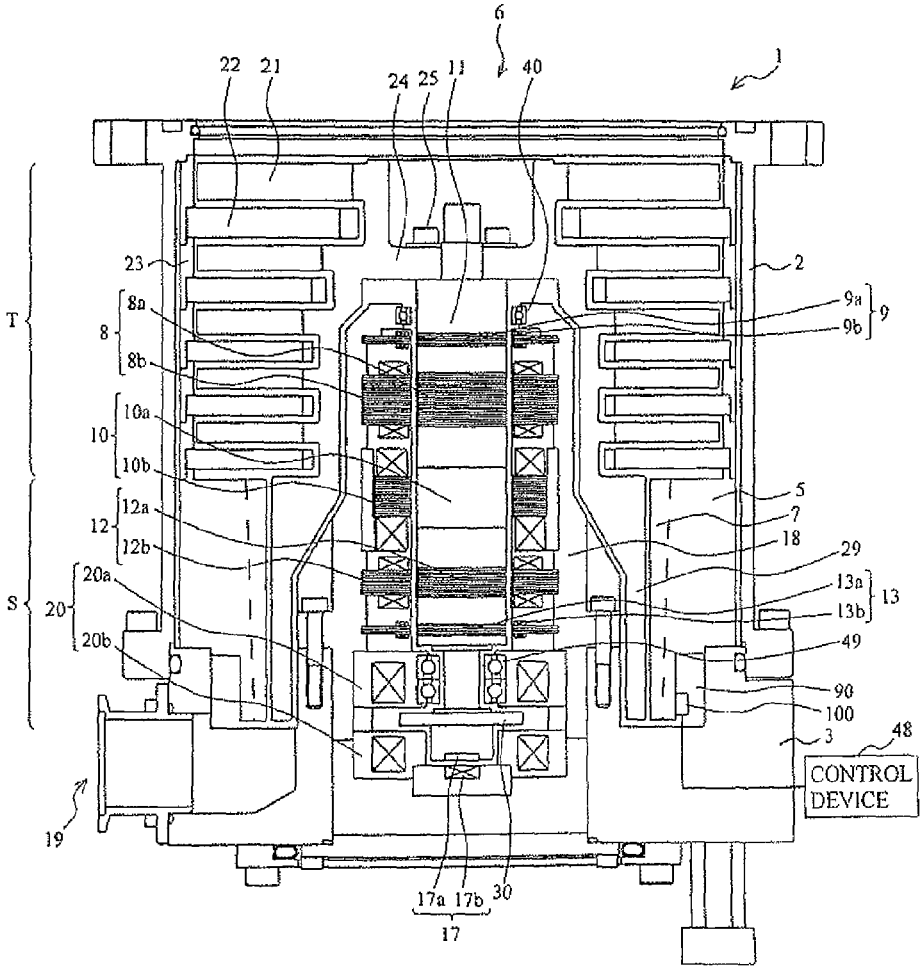
FIG. 1 is a diagram illustrating schematically a turbo-molecular pump according to Embodiment 1.

FIG. 1 is a diagram illustrating schematically a turbo-molecular pump 1 according to Embodiment 1. FIG. 1 illustrates a cross section of the turbo-molecular pump 1 along an axis line direction.

In Embodiment 1 there is explained an example of the turbo-molecular pump 1 on the basis of an example of a so-called composite-blade (composite-type) vacuum pump provided with a turbo-molecular pump section T and a thread groove-type pump section S.

Embodiment 1 and Embodiment 2 may be used in a vacuum pump having only either the turbo-molecular pump section T or the thread groove pump section S, and also in a vacuum pump wherein the thread groove is provided on the side of a rotary body.

A casing 2 that forms a casing of the turbo-molecular pump 1 is shaped as a tube, and makes up the casing of the turbo-molecular pump 1 together with a base 3 that is provided at the bottom of the casing 2. In the interior of the casing of the turbo-molecular pump 1 there is housed a gas transfer mechanism, namely a structure that performs the function of evacuating the turbo-molecular pump 1.

The gas transfer mechanism in the turbo-molecular pump 1 comprises the turbo-molecular pump section T on the side of an inlet port 6, and a thread groove-type pump section S on the side of an outlet port 19.

The structure that brings about that evacuation function comprises broadly a rotor portion rotatably supported and a stator portion fixed to the casing 2.

A control device 48 for controlling the operation of the turbo-molecular pump 1, and provided outside the casing of the turbo-molecular pump 1, is connected to the latter via a dedicated line.

The rotor portion comprises a shaft 11 rotated by a below-described motor section 10, and a rotor section 24.

The shaft 11 is a solid-cylindrical rotary shaft (rotor shaft). A rotor section 24 is mounted, through a plurality of bolts 25, to the top end of the shaft 11.

The rotor section 24 comprises, for instance, a rotary member disposed on the shaft 11. The rotor section 24 comprises rotor blades 21 provided on the side of the inlet port 6 (turbo-molecular pump section T), and a tubular member 29 provided on the side of the outlet port 19 (thread groove-type pump section S).

The rotor blades 21 comprise a plurality of plates that extend radially from the rotor section 24 and are tilted at a predetermined angle with respect to a plane perpendicular to the axis line of the shaft 11. The rotor blades 21 of the turbo-molecular pump 1 are provided as a plurality of stages in the axis line direction.

The rotor section 24 is made up of a metal such as stainless steel, or an aluminum alloy.

The tubular member 29 comprises a member the outer peripheral face whereof is shaped as a tube.

A motor section 10 rotating the shaft 11 is disposed halfway in the axis line direction of the shaft 11.

Through example, the motor section 10 in the present embodiment comprises a DC brushless motor.

A permanent magnet 10*a* is fixed to the site that makes up the motor section 10 in the shaft 11. The permanent magnet 10*a* is fixed in such a manner that, for instance, the N-pole and the S-pole thereof are disposed at 180° about the shaft 11.

Around the permanent magnet 10*a* there are opposingly disposed, for instance, six electromagnets 10*b* at intervals of 60°, symmetrically with respect to the axis line of the shaft 11, with a predetermined gap (clearance) left between the electromagnets and the shaft 11.

The permanent magnet 10*a* functions as a rotor section (rotor portion) of the motor section 10. The electromagnets 10*b* function as a stator section (stator portion) of the motor section 10.

The turbo-molecular pump 1 comprises a sensor that detects the revolutions and the rotation angle (phase) of the shaft 11. Through the sensor, the control device 48 can detect the position of the magnetic poles of the permanent magnet 10*a* thereof fixed to the shaft 11.

The control device 48 consecutively switches current in the electromagnets 10*b* of the motor section 10 in accordance with the position of the detected magnetic poles, to generate thereby a rotating magnetic field around the permanent magnet 10*a* of the shaft 11.

The permanent magnet 10*a* fixed to the shaft 11 follows that rotating magnetic field, and rotates the shaft 11 as a result.

A radial magnetic bearing section 8 and a radial magnetic bearing section 12 that pivotally support the shaft 11 in the radial direction, i.e. that support the load of the rotor portion in the radial direction, are respectively provided at the inlet port 6 side and the outlet port 19 side of the motor section 10.

A thrust magnetic bearing section 20 that pivotally supports the shaft 11 in the axis line direction (thrust direction), i.e. that supports the load of the rotor portion in the thrust direction, is provided at the lower end of the shaft 11.

The shaft 11 (the rotor portion) is supported in the radial direction (direction of the radius of the shaft 11), in a contact-less manner, by the radial magnetic bearing sections 8, 12, and is supported in the thrust direction (axial direction of the shaft 11), in a contact-less manner, by the thrust magnetic bearing section 20. The above magnetic bearings make up a so-called five-axis control-type magnetic bearing, such that the shaft 11 has only one degree of freedom, namely rotation about the axis line.

In the radial magnetic bearing section 8, for instance, four electromagnets 8*b* are opposingly disposed, at 90° intervals around the shaft 11. The electromagnets 8*b* are arranged with a gap (clearance) to the shaft 11. The value of the gap takes on a value arrived at in consideration of, for instance, the steady-state amount of vibration (runout amount) of the shaft 11, the spatial distance between the rotor section 24 and the stator section (stator portion), and the characteristics of the radial magnetic bearing section 8.

A target 8*a* is formed in the shaft 11, opposing the electromagnets 8*b*. The target 8*a* is attracted by the magnetic force of the electromagnets 8*b* of the radial magnetic bearing section 8, as a result of which the shaft 11 is supported, in a contact-less manner, in the radial direction.

The target 8*a* functions as a rotor section of the radial magnetic bearing section 8, and the electromagnets 8*b* function as a stator section of the radial magnetic bearing section 8.

The radial magnetic bearing section 12 is configured in the same way as in the radial magnetic bearing section 8, specifically, in that a target 12*a* is attracted by the magnetic force of the electromagnets 12*b* of the radial magnetic bearing section 12, whereby the shaft 11 is supported, in a contact-less manner, in the radial direction.

The thrust magnetic bearing section 20 floats the shaft 11 in the axial direction, through an interposed disc-like metallic armature disc 30 that is provided perpendicularly to the shaft 11.

In the thrust magnetic bearing section 20, for instance two electromagnets 20*a*, 20*b* are disposed opposing each other across the armature disc 30. The electromagnets 20*a*, 20*b* are arranged with a gap between the electromagnets 20*a*, 20*b* and the armature disc 30.

This gap takes on a value arrived at in consideration of, for instance, the steady-state amount of vibration of the shaft 11, the spatial distance between the rotor section 24 and the stator section, and the characteristics of the thrust magnetic bearing section 20.

The armature disc 30 is attracted by the magnetic force of the electromagnets 20*a*, 20*b* of the thrust magnetic bearing section 20, as a result of which the shaft 11 is supported, in a contact-less manner, in the thrust direction (axis line direction).

Displacement sensors 9, 13 are respectively formed in the vicinity of the radial magnetic bearing sections 8, 12, in such a way so as to be capable of detecting displacement of the shaft 11 in the radial direction. A displacement sensor 17 is formed at the lower end of the shaft 11 in such a way so as to be capable of detecting the displacement of the shaft 11 in the axis line direction.

The displacement sensors 9, 13 are elements that detect the displacement of the shaft 11 in the radial direction. In the present embodiment, the displacement sensors 9, 13 are inductive-type sensors, such as eddy current sensors or the like, provided with coils 9*b*, 13*b*.

The coils 9*b*, 13*b* of the displacement sensors 9, 13 make up part of an oscillation circuit formed in the control device 48 that is disposed outside the turbo-molecular pump 1. In response to oscillation by the oscillation circuit, a high-frequency current flows through the displacement sensor 9, whereupon the latter generates a high-frequency magnetic field at the shaft 11.

The oscillation amplitude of the oscillation circuit changes accompanying changes of the distance between the displacement sensors 9, 13 and the targets 9*a*, 13*a*. The displacement sensor can detect the displacement of the shaft 11 thereby.

The sensor used for detecting the displacement of the shaft 11 is not particularly limited to the above, and may be, for instance, a capacitive sensor, an optical sensor or the like.

Upon detection of displacement of the shaft 11 in the radial direction, according to signals from the displacement sensors 9, 13, the control device 48 adjusts the magnetic force of the electromagnets 8*b*, 12*b* of the radial magnetic bearing sections 8, 12, whereby the shaft 11 returns to a predetermined position.

Thus, the control device 48 performs feedback control of the radial magnetic bearing sections 8, 12 on the basis of signals from the displacement sensors 9, 13. As a result, the shaft 11 levitates magnetically in the radial direction, with a predetermined gap (clearance) to the electromagnets 8*b*, 12*b*. The shaft 11 is thus held the space, in a contact-less manner, in the radial magnetic bearing sections 8, 12.

Similarly to the displacement sensors 9, 13, the displacement sensor 17 comprises a coil 17*b*. Displacement in the thrust direction is detected through detection of the distance to a target 17*a* that is provided on the side of the shaft 11 opposing the coil 17*b*.

Upon detection of displacement of the shaft 11 in the thrust direction, on the basis of a signal from the displacement sensor 17, the control device 48 adjusts the magnetic force of the electromagnets 20*a*, 20*b* of the thrust magnetic bearing section 20, whereby the shaft 11 returns to a predetermined position.

Thus, the control device 48 performs feedback control of the thrust magnetic bearing section 20 on the basis of a signal from the displacement sensor 17. As a result, the shaft 11 levitates magnetically in the thrust direction, with a predetermined gap (clearance) to the electromagnets 20*a*, 20*b*, in the thrust magnetic bearing section 20. The shaft 11 is thus held in space in a contact-less manner.

That is, the shaft 11 is held by the radial magnetic bearing sections 8, 12 in the radial direction, and is held by the thrust magnetic bearing section 20 in the thrust direction. The shaft 11 rotates as a result in such a way so as to rotate about the axis line.

A gas transfer mechanism, namely the stator section (stator portion) having a structure for performing an evacuation function, is formed inside the casing 2 and the base 3. The stator section comprises, for instance, stator blades 22 provided on the side of the inlet port 6 (turbo-molecular pump section T), a thread groove spacer 5 provided on the side of the outlet port 19 (thread groove-type pump section S), as well as a stator column 18.

The stator blades 22 comprise a plurality of plates that extend from the inner peripheral face of the casing 2 towards the shaft 11 and that are tilted at a predetermined angle with respect to a plane perpendicular to the axis line of the shaft 11. In the turbo-molecular pump section T, the stator blades 22 are formed at a plurality of stages, alternately with the rotor blades 21, in the axis line direction. The stator blades 22 of each stage are spaced apart from each other by tubular spacers 23.

The thread groove spacer 5 is a tubular member having a helical groove 7 formed in the inner peripheral face, and formed to a thinner wall thickness on the side of the outlet port 19 (in the vicinity of the base 3). A clearance 90 is provided between the base 3 (or casing 2) and the outer peripheral face of the thread groove spacer 5, at a site where the wall of the latter is thinner.

A vibration sensor 100 is provided, taking advantage of the clearance 90, at the outer peripheral face of the thread groove spacer 5, at a site where the wall of the latter is thinner.

The vibration sensor 100 functions as a contact detection means for detecting contact between the rotor portion and the stator portion inside the turbo-molecular pump 1. The vibration sensor 100 comprises, for instance, an acceleration pickup, a piezoelectric element, a moving coil, a strain gauge or the like.

Although not shown in the figures, a sensitivity adjustment device (sensitivity adjustment function) of the vibration sensor 100 is built into the turbo-molecular pump 1. The conversion rate (conversion sensitivity) with which a vibration level is converted to an electric signal must be adjusted in each vibration sensor 100, due to individual differences.

By providing thus a sensitivity adjustment device in the turbo-molecular pump 1, the sensitivity of the vibration sensor 100 does not have to be adjusted every time that a combination of the control device 48 is modified (connection to another control device 48).

The inner peripheral face of the thread groove spacer 5 opposes the outer peripheral face of the tubular member 29, with a predetermined gap left in between.

The direction of the helical groove 7 formed in the thread groove spacer 5 is the direction in which gas moves towards the outlet port 19, in a case where gas is transported, along the helical groove 7, in the rotation direction of the rotor section 24. The depth of the helical groove 7 is set so as to grow shallower nearer the outlet port 19.

The gas transported along the helical groove 7 becomes compressed as it approaches the outlet port 19.

The base 3 comprises the casing 2 as well as the casing of the turbo-molecular pump 1. The tubular stator column 18, which is formed concentrically with the rotation axis line of the rotor portion, is mounted at the center of the base 3, in the radial direction, on the side of the inlet port 6.

The motor section 10 and the radial magnetic bearing sections 8, 12 are disposed inside the stator column 18.

In the turbo-molecular pump 1, a protective bearing 40 is provided on the inlet port 6 side of the displacement sensor 9, and a protective bearing 49 is provided on the outlet port 19 side of the displacement sensor 13.

The protective bearings 40, 49 are bearings for supporting the shaft 11, for instance upon startup and stop of the turbo-molecular pump 1, or at times when the radial magnetic bearing sections 8, 12 and/or the thrust magnetic bearing section 20 are not working normally (touchdown), for instance during a power outage.

The turbo-molecular pump 1 having the above-described configuration is used as a vacuum pump during evacuation of a vacuum vessel, for instance a process chamber or the like the interior of which is kept at a high vacuum and in which there is provided, for instance, a semiconductor manufacturing device.

The turbo-molecular pump 1 sucks and evacuates a process gas from the interior of the process chamber. The process gas is introduced into the chamber while at a high temperature, for increasing reactivity. While being evacuated, however, part of the process gas condenses into a solid product, in the turbo-molecular pump 1, when pressure is equal to or greater than a given pressure, or through cooling. This solid product forms deposits that adhere to flow path surfaces in the turbo-molecular pump 1.

The spacing between the rotor portion and the stator portion in the turbo-molecular pump 1, for instance the spacing between the rotor blades 21 and the stator blades 22, and the spacing between the tubular member 29 and the thread groove spacer 5, is very narrow. As a result, the rotor portion and the stator portion may come into contact with each other, through the above-described solid product, when the solid product forms deposited at the clearance between the rotor portion and the stator portion in an amount equal to or greater than a predetermined amount.

The rotor portion in the turbo-molecular pump 1 rotates at high speed, at several tens of thousands rpm. As a result, contact between the rotor portion and the stator portion may give rise to, for instance, deformation and breakage (destruction).

In Embodiment 1 and Embodiment 2, contact between the rotor portion and the stator portion inside the turbo-molecular pump is detected using a vibration sensor.

Figure 2:
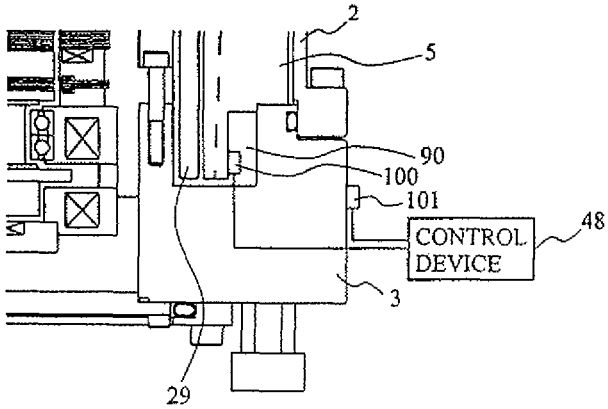
Figure 2:
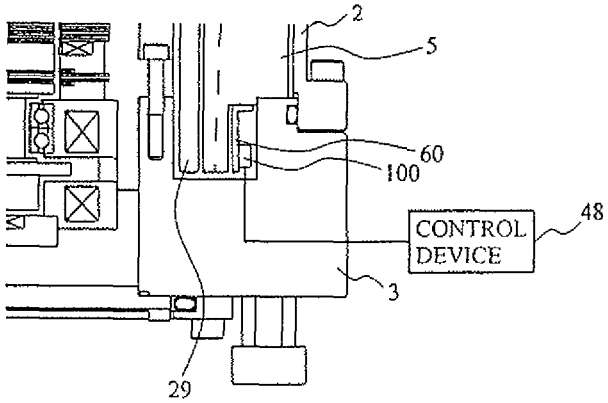
Figure 2:
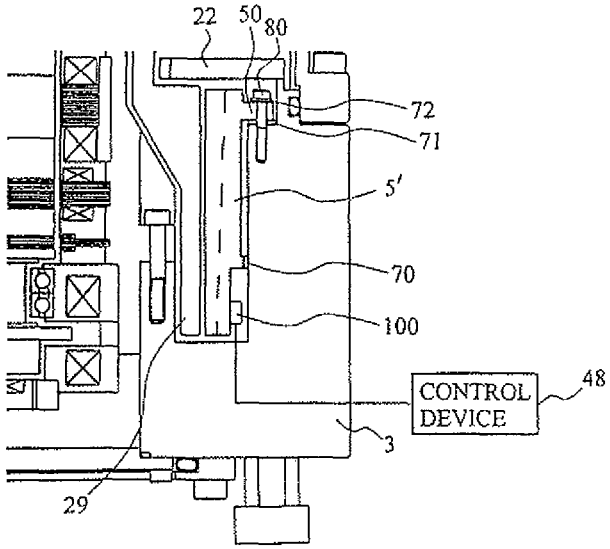

Embodiment 1 will be explained first with reference to FIG. 1 and FIG. 2.

In the turbo-molecular pump 1 (control device 48), specifically, contact between the rotor portion and the stator portion of the turbo-molecular pump 1 is detected when the vibration detected by the vibration sensor 100 satisfies any of the conditions below:

(1) When the vibration level (magnitude of the amplitude) at the natural frequency of a part that makes up the stator portion (stator blades 22, spacers 23, thread groove spacer 5) exceeds a predetermined threshold value.

(2) When the vibration level at the natural frequency of a part that makes up the rotary body (rotor blades 21, tubular member 29, shaft 11, rotor section 24) exceeds a predetermined threshold value, at the revolutions (frequency) of the rotor portion.

(3) When the vibration level at frequency that is a multiple of the revolutions (frequency) of the rotor portion exceeds a predetermined threshold value.

(4) When the vibration level of a vibration beat (composite vibration) at a specific frequency set forth in (1) to (3) exceeds a predetermined threshold value.

(5) When the vibration level of an elastic wave (acoustic emission) within a specific range (several hundred to several thousand of kHz) generated upon contact between the rotor portion and the stator portion exceeds a predetermined threshold value.

With misdetection of the vibration sensor 100 in mind, among other considerations, contact between the stator portion and the rotor portion may also be detected for instance in cases where phenomena that satisfy the above conditions occur a plurality of times within a predetermined lapse of time, or occur continuously over a predetermined lapse of time.

The control device 48 is configured in such a way so as to issue an alarm signal, denoting an abnormal state, when the above-described vibration is detected (sensed) by the vibration sensor 100. Upon issuing of the above alarm signal, the turbo-molecular pump 1 of the present embodiment automatically stops running, in order to prevent breakage of the parts.

With a view to avoiding the influence of external shocks (perturbations) or misdetection due to noise in the vibration sensor 100, the control device 48 may be provided with a timer function, such that operation of the turbo-molecular pump 1 is stopped when the alarm signal is issued continuously for a time equal to or longer than a predetermined time.

With misdetection of the vibration sensor 100 in mind, the alarm signal may be set to be issued when the time interval (detecting timing interval) at which the above-described vibration is detected (sensed) by the vibration sensor 100 shrinks over time and becomes shorter than a predetermined interval time (period).

Also, the alarm signal may be set to be issued only when the revolutions at which contact is detected exceeds predetermined revolutions (threshold value), or only when an integrated value of the time over which contact is detected exceeds a predetermined time (threshold value)

The timing at which an alarm signal is issued is not limited to the above conditions.

For instance, the approach of a maintenance period can be notified in advance through issuing of an alarm signal over a plurality of times (for instance, in two stages), so as to prevent the turbo-molecular pump 1 from becoming unusable all of a sudden.

Specifically, an alarm signal is issued that informs about an early stage of contact between the rotor portion and the stator portion. An alarm signal is issued thereafter that notifies that contact has progressed to a stage at which the turbo-molecular pump 1 is automatically stopped (or stoppage is urged)

The timing at which there are generated such alarm signals denoting level differences in the degree of contact may be set arbitrarily, on the basis of, for instance, the revolutions at which contact is detected, an integrated value of the time over which contact is detected, or variations in the contact detection intervals.

The following intermittent contact phenomena occur until permanent contact is reached:

contact due to solid products→wear at contact portions→temporary non-contact states→progressive deposition of solid product and/or rotor portion deformation (for instance, expansion of the tubular member 29)→permanent contact. Contact sites grow, and the above cycle shortens transiently, as deposition of solid product and deformation of the rotor portion progress as described above.

Therefore, the alarm signal may be issued in accordance with the contact level, while under monitoring of the timing at which the above contact cycle intervals, i.e. contact detection intervals, become transiently shorter.

The operation of the turbo-molecular pump 1 can be stopped at an appropriate period (timing), through issuing of an alarm signal, in a case where the vibration sensor 100 detects a particular vibration during contact between the rotor portion and the stator portion such as the one described above. This allows forestalling damage (breakage) of the parts of the turbo-molecular pump 1, and allows reducing the running costs of the turbo-molecular pump 1, while improving safety.

The purpose of the above-described determination conditions in per (1) to (5) is to grasp not only vibration amplitude, but also particular vibrations that occur during contact between the rotor portion and the stator portion, and to distinguish (identify) the latter from vibration caused by growing unbalance over time and/or by external vibration.

Vibration is induced between the rotor portion and the stator portion due to the shock therebetween when the two come into contact. In the present embodiment, the occurrence or not of contact between the rotor portion and the stator portion is determined on the basis of a component of that induced vibration.

The conditions as per (1) and (2) above are set by exploiting the property (characteristic) whereby amplitude is maximum at the natural frequency for which damping of each part is minimum, in vibration induced by contact at the various constituent parts.

Although extraneous vibration induces also vibration of the parts at the natural frequency, the induced vibration level of the part directly induced to vibrate by contact is large. Therefore, contact can be determined to have occurred when that vibration level exceeds significantly a predetermined threshold value.

The natural frequency of parts according to the above conditions includes also the natural frequency derived from the site at which the part is integrally formed, and the natural frequency derived from (due to) the rigidity of the mounting section of the part.

The natural frequency of a part changes accompanying changes in the dimensions of the part, due to the temperature or to mechanical tolerances of the part, and accompanying changes in the rigidity of the mounting section. Therefore, vibration detection of some parts at the natural frequency involves grasping a peak value of vibration within a frequency range having a given degree of clearance (margin).

In the present embodiment, a signal that is been converted to an electric signal by a detection means such as the vibration sensor 100 is extracted by a bandpass filter that lets an envisaged frequency band through, and the magnitude of the extracted signal is compared against a predetermined threshold value, to determine thereby the occurrence or not of contact between the rotor portion and the stator portion.

Vibration at the natural frequency of the parts that make up the rotary body occurs also even when the rotary body and the stator portion are not in contact. This vibration is transmitted towards the stator portion via the shaft 11 and so forth. Therefore, the predetermined threshold value in the condition set forth in per (2) is set to a value that allows appropriately excluding such a vibration level, at the natural frequency of the parts that make up the rotary body and that is normally transmitted towards the stator portion.

The natural frequency of parts that make up the rotary body changes in accordance with the revolutions, due to the action of the centrifugal force and gyroscopic moment.

In the present embodiment, therefore, the characteristic (pass band characteristic) of the above-described bandpass filter is modified beforehand in accordance with the revolutions of the rotor portion. For instance, mapping information on how the filter characteristic changes in accordance with the revolutions is stored beforehand in the control device 48, and the settings of the filter that is used are modified on the basis of the mapping information. There may be used a bandpass filter having an expanded frequency band in response to envisaged changes in the natural frequency, although in this case detection precision is lower.

The grounds for setting condition as per (3) above are as follows.

(a) The rotation frequency yield the frequency of the main vibration-inducing force of vibration that is induced by contact between the rotor portion and the stator portion, so that vibration at a multiple of that frequency is induced at parts on the side of the stator portion.

(b) A plurality of runouts (offset) off the ideal center of the shaft 11 occur at the surface of the rotor portion, on account of the mechanical machining precision of the parts that make up the rotary body, and on account of the mounting tolerances of the shaft 11 and the rotor blades 21. Vibration arises at a multiple of the revolutions when contact occurs several times per rotation.

(c) From among the parts where contact occurs, those parts having a plurality of sites (n sites) per circumference at which the clearance between the rotor portion and the stator portion becomes narrower, exhibit vibration in accordance with the number of sites (n), namely vibration equivalent to revolutions×n. In the thread groove-type pump section S, for instance, thread ridges are disposed substantially equidistantly in the peripheral direction of the thread groove spacer 5.

The condition as per (3) above is set thus on the above grounds.

Vibration at a multiple of revolutions occurs also even when the rotor portion and the stator portion are not in contact. This vibration is transmitted towards the stator portion via the shaft 11 and so forth. Therefore, the predetermined threshold value in the condition set forth in (3) is set to a value that allows appropriately excluding such a vibration level that is normally transmitted towards the stator portion.

During contact between the rotor portion and the stator portion, there is induced not vibration of a single frequency alone; instead, there arise simultaneously induced vibrations according to the specific frequencies set forth in per (1) to (3). The condition according to per (4) is prescribed for this reason.

Embodiment 1

Variation 1

The configuration of the detection means for detecting contact between the rotor portion and the stator portion inside the turbo-molecular pump 1 is not particularly limited to that of the above embodiment.

FIG. 2A illustrates a configuration example of another detection means.

As illustrated in FIG. 2A, a vibration sensor 101 may be provided on the outer peripheral face of the base 3, so that vibration is detected using two sensors, i.e. the vibration sensor 100 and the vibration sensor 101.

Specifically, the vibration sensor 100 is disposed on the thread groove spacer 5, and the vibration sensor 101 is disposed on the base 3 to which the thread groove spacer 5 is fixed. Thus, the vibration sensor 101 is disposed at a different part (base 3) that is built on a part (thread groove spacer 5) at which the vibration sensor 100 is disposed. That is, the vibration sensors 100, 101 are disposed not on a same part comprised in the stator portion, but at respective parts having a different build-up order.

The vibration sensor 101 provided at the outer peripheral face of the turbo-molecular pump 1 (base 3), as illustrated in FIG. 2A, can sense more distinctly vibration caused by external shocks (disturbances).

Herein there is calculated the difference between the detecting results (output signals) from the vibration sensor 100 disposed on the side of the rotor portion (contact portion) and from the vibration sensor 101 disposed at a site physically spaced apart from the rotor portion (contact portion), i.e. disposed at a distant site or a site having a different build-up order. The occurrence or not of contact between the stator portion and the rotor portion is determined by the control device 48 on the basis of this calculated differential signal.

Vibration generated upon contact between the rotor portion and the stator portion is greatest at the contact portion, and tends to decrease gradually away from the contact portion, due to vibration damping at transmitting parts. This relationship is reversed for extraneous vibration.

In Variation 1 of Embodiment 1, therefore, the above characteristic is exploited by further providing the vibration sensor 101 at a part that is physically spaced apart from the contact portion, and by predominantly grasping contact-derived vibration on the basis of the difference (differential signal) between signals obtained from the vibration sensor 101 and the vibration sensor 100.

Specifically, it is determined whether the calculated differential signal satisfies any one of the above-described determination conditions in per (1) to (5). As in the Embodiment 1, contact between the stator portion and the rotor portion is detected to occur in the turbo-molecular pump 1 when any of the conditions is satisfied.

In the present embodiment variation, an instance has been explained in which the vibration sensor 101, which detects a comparative signal resulting from calculating a differential signal vis-à-vis the vibration sensor 100, is disposed at the base 3 that is built up on the thread groove spacer 5. However, the site at which the vibration sensor 101 is disposed is not limited to the above-described one, and the vibration sensor 101 may be provided at another stator portion (for instance, the casing 2) that is built up on the thread groove spacer 5.

Embodiment 1

Variation 2

The explanation of Embodiment 1 above dealt with an instance where the vibration sensor 100 that detects vibration is disposed directly on the thread groove spacer 5. The way in which the vibration sensor 100 is disposed is not limited to the above-described one.

FIG. 2B is a diagram illustrating another arrangement example of the vibration sensor 100.

As illustrated in FIG. 2B, for instance, a vibration sensor 100 may be disposed on the stator portion via a plate-like brace 60 that is mounted to the thread groove spacer 5.

Specifically, the brace 60 having an L-shaped cross section may be mounted to a shoulder formed on the thread groove spacer 5, on the side of the outlet port 19, in such a manner that the long limb of the L-shape is parallel to the outer peripheral wall of the thread groove spacer 5. The vibration sensor 100 is then disposed on the side face of the long limb of the L-shape of the brace 60.

The brace 60 is configured in such a manner that the natural frequency of the brace 60 itself is an induced vibration frequency according to the determination conditions in per (1) to (5) above, or a frequency that is an approximate multiple of the induced vibration.

In Variation 2 of Embodiment 1, the vibration sensor 100 is disposed via the brace 60 in order to grasp an enlarged (amplified) vibration induced at the site on a stator portion side. The vibration (amplitude) generated in the turbo-molecular pump 1 can be easily amplified as a result, which in turn allows increasing the vibration detection precision.

The extracted vibration frequency can be appropriately narrowed down by providing the vibration sensor 100 via the brace 60. This allows increasing the vibration detection precision.

The vibration level at the natural frequency of the brace 60 is significantly large within the vibration detected by the vibration sensor 100 upon occurrence of contact between the rotor portion and the stator portion inside the turbo-molecular pump 1. Therefore, the occurrence or not of contact between the rotor portion and the stator portion can be sufficiently determined by monitoring (controlling) the vibration level (amplitude magnitude) at the natural frequency of the brace 60, as a part that makes up the stator portion.

Embodiment 1

Variation 3

In order to reduce the influence of external shocks (disturbances) on the vibration sensor 100 that detects vibration, the stator portion (thread groove spacer 5') at which the vibration sensor 100 is disposed may be fixed to the casing (casing 2, base 3) through a vibration damping member (elastomer) having a higher (greater) vibration damping coefficient than that of the fixed member at which the vibration sensor 100 is disposed.

FIG. 2C is a diagram illustrating an arrangement example in which a vibration damping member is used.

As illustrated in FIG. 2C, specifically, an elastic member 70 is disposed between the outer peripheral side face of the thread groove spacer 5' and the inner peripheral side face of the base 3.

An elastic member 71 is disposed between the mounting face of the base 3 and a flange-like mounting section 50, for the base 3, disposed on the inlet port 6 side of the thread groove spacer 5'.

Further, a washer 72 of a bolt 80 that fixes (fastens) the mounting section 50 of the thread groove spacer 5' against the base 3 comprises an elastic body.

The vibration level transmitted from outside can be thus reduced by fixing the stator portion (thread groove spacer 5'), at which the vibration sensor 100 is mounted, to the casing via the elastic members 70, 71, and via the elastic washer 72, that have a vibration absorption (vibration damping) function. This allows increasing as a result the sensing precision of the particular vibration generated during contact between the rotor portion and the stator portion. Preferably, the vibration absorption (vibration damping) member comprises a resin-made member of, for instance, rubber, plastic or the like.

A structure that uses such a vibration damping member (elastic member/elastic body) may be used not only in Variation 3 of Embodiment 1, but also in any of the other above-described variations.

In Embodiment 1 and variations thereof described above there have been explained instances where the vibration sensor 100 for detecting the particular vibration that occurs upon contact between the rotor portion and the stator portion is mounted on a portion at which the rotor portion and the stator portion are likely to come into contact, i.e. a portion in the vicinity of a downstream side (outlet port 19 side) of a gas transfer path at which solid products are likely to deposit.

However, the mounting site of the vibration sensor 100 is not limited to the above-described one. The vibration sensor 100 may be provided at another stator portion that opposes the rotor portion, for instance, on the stator blades 22 or the spacers 23.

In this case as well, as in the above-described embodiment variations, contact may be detected on the basis of a differential signal with respect to the vibration sensor 101 disposed on the base 3 or the casing 2; the vibration sensor 100 may be mounted via a brace; and a vibration damping member may be provided against the casing.

Embodiment 1

Variation 4

In Embodiment 1 and Variations 1 to 3 thereof, an instance where the vibration sensor 100 is disposed on the stator portion side has been explained as a method for detecting contact between the rotor portion and the stator portion inside the turbo-molecular pump 1. However, the method for detecting the particular vibration that occurs during contact between the rotor portion and the stator portion is not limited to the above-described one.

For instance, the occurrence or not of contact between the rotor portion and the stator portion may also be detected by detecting the vibration of the rotor portion, i.e. the change over time of the displacement of the rotor portion.

Specifically, there is provided a sensor that monitors the displacement of the rotor portion (rotary body), for instance, the shaft 11, the rotor section 24 (rotor blades 21, tubular member 29), such that the occurrence or not of contact between the rotor portion and the stator portion is determined on the basis of the detection results (detecting results) of this sensor.

The sensor may comprise, for instance, an inductive-type, an eddy current-type, a capacitive-type or optical-type contact-less displacement sensor that converts the vibration of the rotor portion into an electric signal. The sensor (contact-less sensor) for detecting contact between the rotor portion and the stator portion may be configured so as to double as the displacement sensors 9, 13 used for controlling the radial magnetic bearing sections 8, 12.

Whether or not the vibration of the rotor portion satisfies any of the above-described determination conditions in per (1) to (5) is determined on the basis of the monitoring results of the displacement of the rotor portion.

Thus, the occurrence or not of contact between the rotor portion and the stator portion can be determined through direct monitoring of the vibration of the rotor portion.

With misdetection by the sensor in mind, among other considerations, detecting by the sensor may be configured, as in Embodiment 1 above, in such a manner so as to sense the occurrence of contact between the rotor portion and the stator portion in cases where phenomena that satisfy the above conditions occur a plurality of times within a predetermined lapse of time, or occur continuously over a predetermined lapse of time.

There may also be detected the displacement (vibration) of a brace member, identical to that of the above-described brace 60, that is fixed to the rotor portion. Preferably, this brace member is disposed at a site where contact with the stator portion is anticipated.

The vibration (amplitude) occurring in the turbo-molecular pump 1 can be easily amplified by detecting the vibration of the rotor portion through the brace member. This allows enhancing the vibration detection precision.

Embodiment 2 will be explained first with reference to FIG. 3 to FIG. 7. In Embodiment 2, elements identical to those of Embodiment 1 will be denoted with the same reference numerals, and an explanation thereof will be omitted.

In a turbo-molecular pump 1' of Embodiment 2, a sensitivity adjustment device 103 is provided on the inner peripheral face of the substantially tubular base 3. The arrangement position of the sensitivity adjustment device 103 is not limited thereto, and the sensitivity adjustment device 103 may be disposed at or inside the casing, for instance at a in-pump board 104 that is fixed to the thrust magnetic bearing section 20, or at a rear cap 105 that covers the opening of the base 3, or at the outer peripheral face of the casing (casing 2, base 3).

By providing thus the sensitivity adjustment device 103 on the side of the main body of the turbo-molecular pump 1', the sensitivity of the vibration sensor 102 does not have to be adjusted every time that a combination of the control device 48 is modified (connection to another control device 48). As a result, replacement of the turbo-molecular pump 1' no longer requires, for instance, a measurement instrument or the like for sensitivity adjustment. The replacement operation can be made thus simpler and more convenient.

Figure 3:
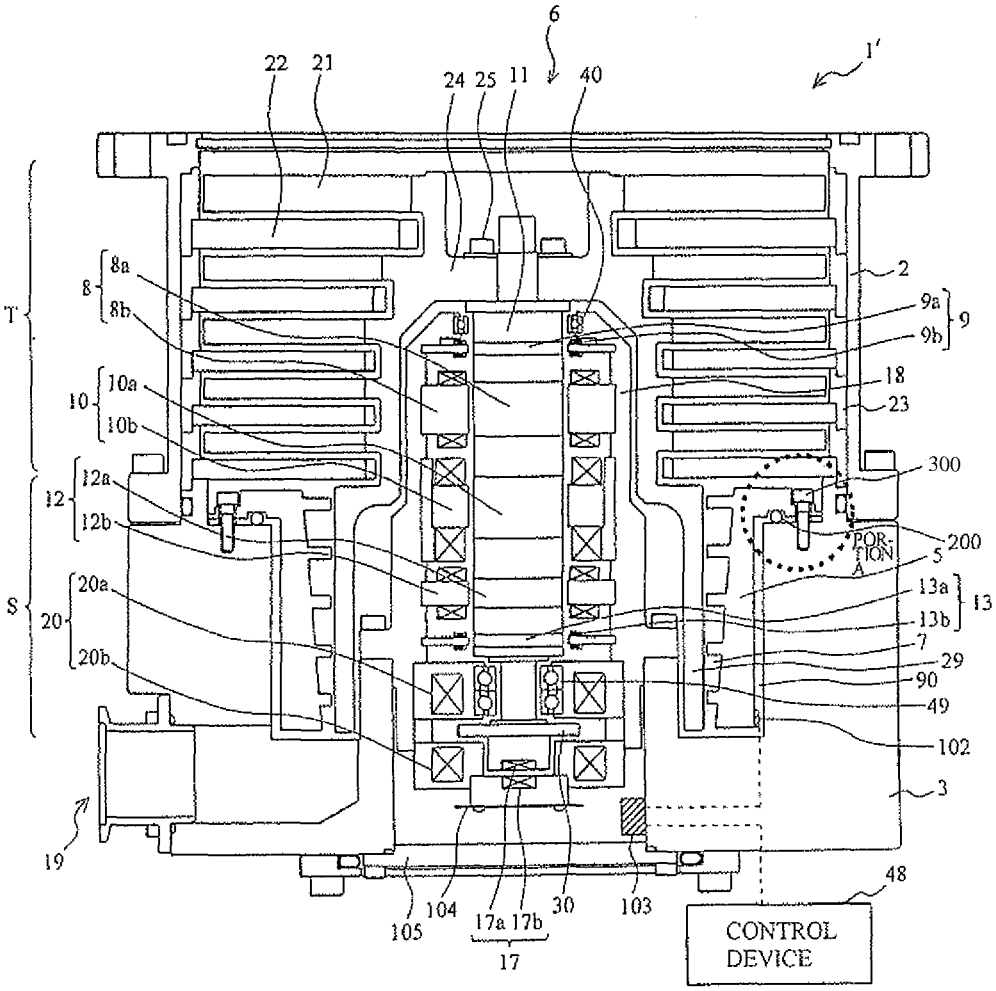
FIG. 3 is a diagram illustrating schematically a turbo-molecular pump according to Embodiment 2.
Figure 4:
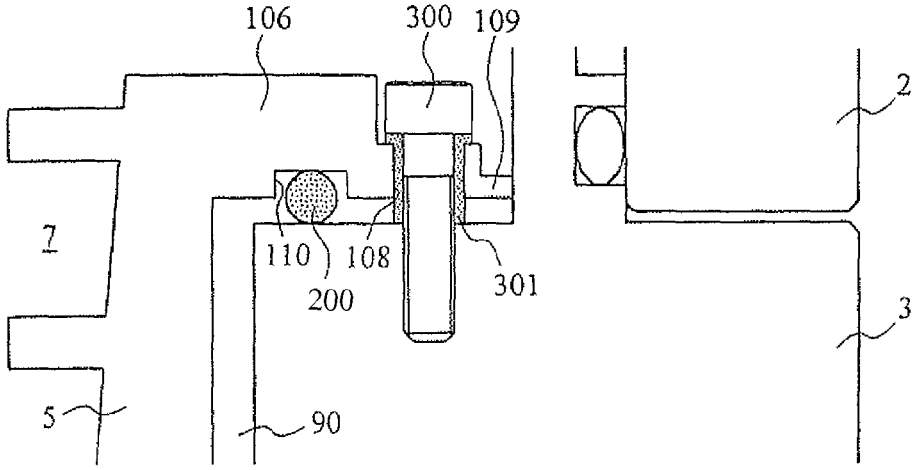
FIG. 4 is an enlarged diagram of a portion of broken line A illustrated in FIG. 3.
Figure 5:
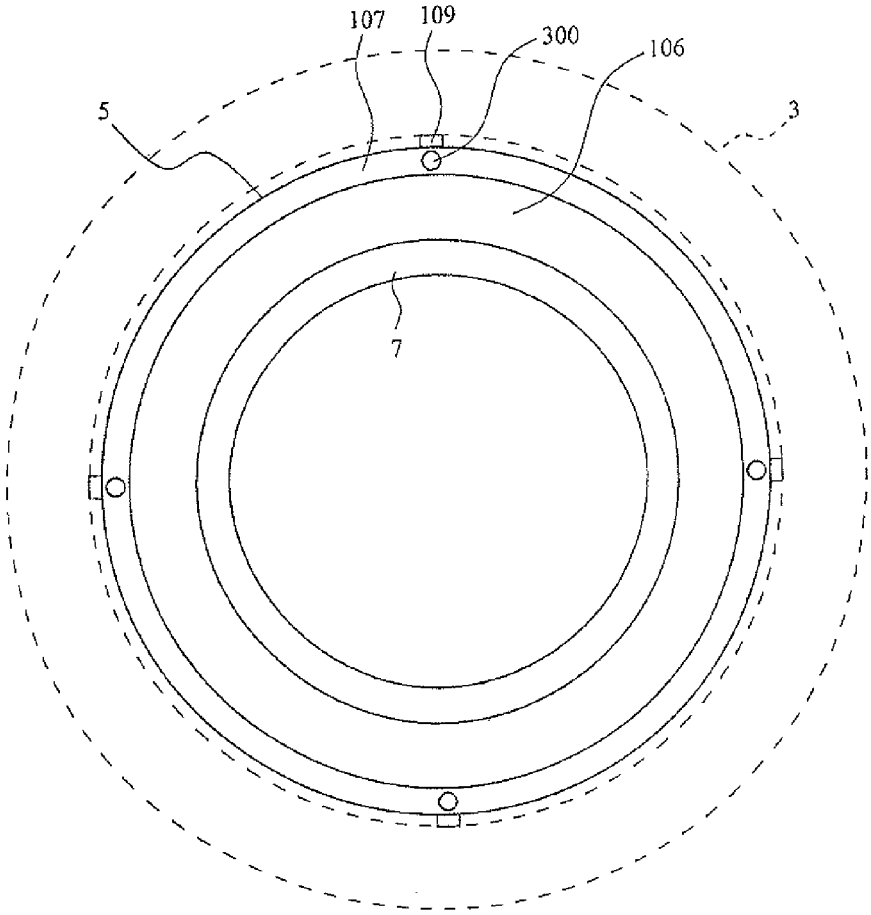
FIG. 5 is a plan-view diagram of a thread groove spacer according to Embodiment 2 mounted to a base, viewed from an inlet port.
Figure 6:
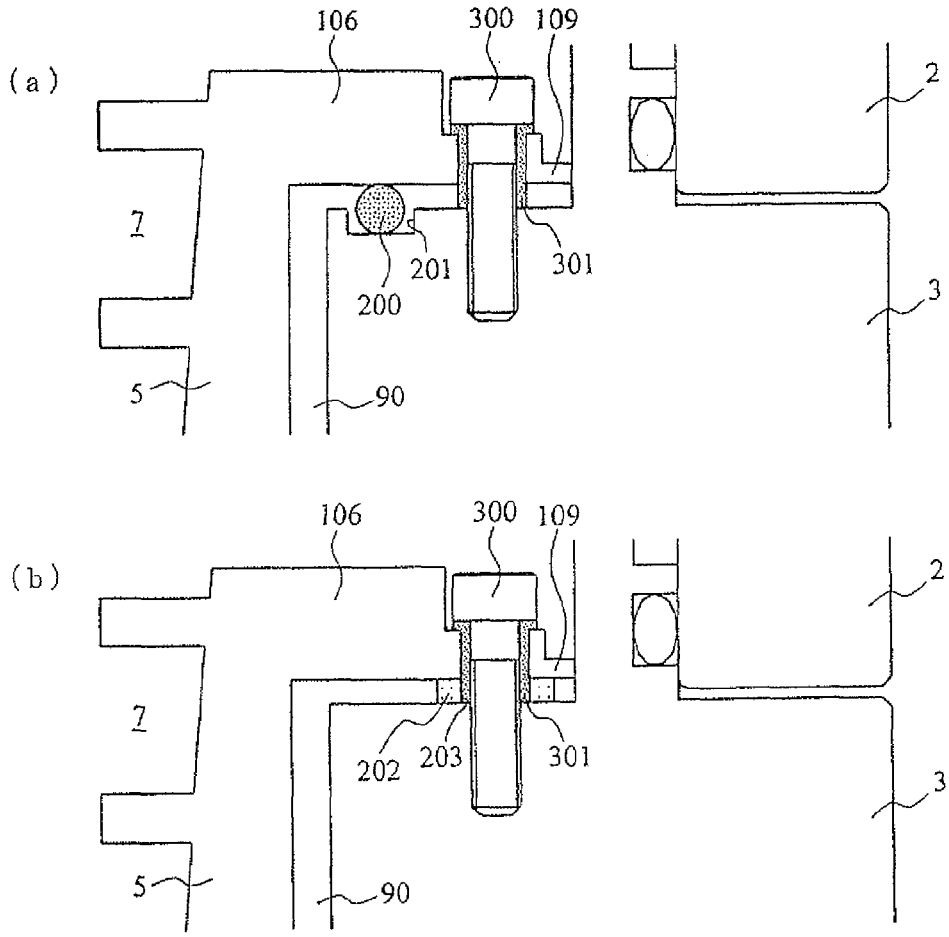
FIG. 6A and FIG. 6B are diagrams illustrating variations of a mounting method of the thread groove spacer according to Embodiment 2.
Figure 7:
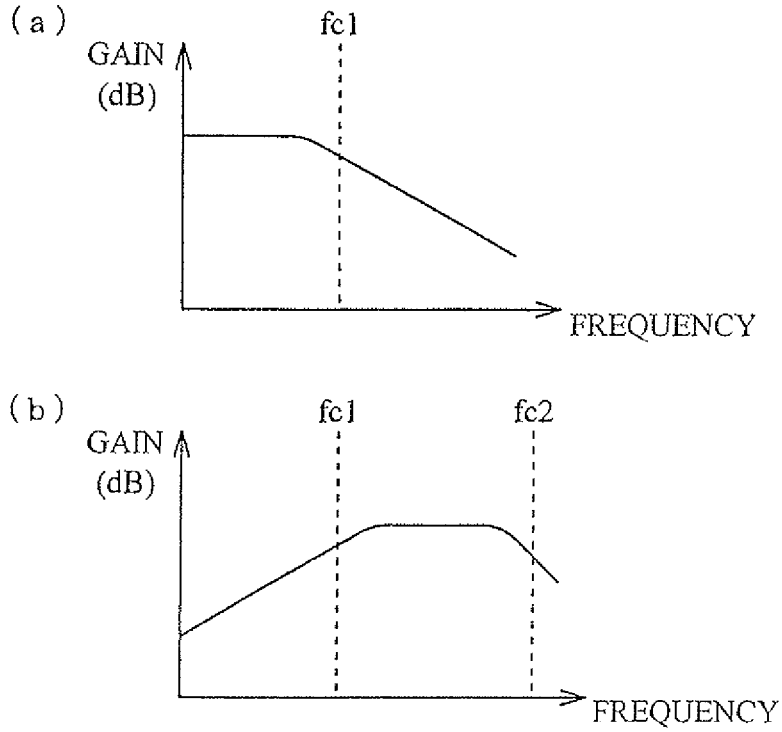
FIG. 7A is a graph illustrating a vibration propagation characteristic of an elastic member.
FIG. 7B is a graph illustrating a vibration signal damping characteristic of a digital filter in a supervisor circuit.

FIG. 4 is an enlarged diagram of the portion of broken line A illustrated in FIG. 3. FIG. 5 is a plan-view diagram of the thread groove spacer 5 mounted to the base 3, viewed from the inlet port 6.

The details of the method for mounting the thread groove spacer 5 are explained next. The thread groove spacer 5 is mounted to the base 3 through a plurality of bolts 300, via an O-ring 200.

As illustrated in FIG. 5, an outward-flaring ring-like flange section 106 for fixing is provided at an end of the thread groove spacer 5, on the inlet port 6 side of the tubular shape of the inner peripheral face of the thread groove spacer 5 at which the helical groove 7 is formed. A ring-like mounting section 107, thinner than the flange section 106, is provided at the outer peripheral edge of the flange section 106. As illustrated in FIG. 4, four bolt holes 108 for insertion of the fixing bolts 300 are equidistantly formed along the circumference of the mounting section 107. Also, four claws 109 for positioning the thread groove spacer 5 are provided in the mounting section 107, protruding from the outer peripheral edge of the latter towards the casing 2, the four claws 109 being equidistantly formed along the circumference of the mounting section 107. The claws 109 are formed so as to have a sufficiently small contact surface area with the casing (casing 2, base 3) in order to suppress the influence of extraneous vibration that is transmitted from the casing to the thread groove spacer 5.

A ring groove 110 for fitting and fixing the O-ring 200 is formed along the circumferential direction of the thread groove spacer 5, in the surface of the outlet port 19 side of the flange section 106.

The flange section 106 is fixed to the end face of the base 3, on the side of the inlet port 6, through the bolts 300, in a state where the O-ring 200 is fitted and fixed (temporarily fixed) to the ring groove 110.

In Embodiment 2, tubular bushes (bushings) 301 for preventing direct contact between the thread groove spacer 5 (mounting section 107) and the bolts 300 are disposed in the bolt holes 108, with a view to suppressing the influence of extraneous vibration that is transmitted from the casing (casing 2, base 3) to the thread groove spacer 5, via the bolts 300. Specifically, the thread groove spacer 5 is mounted to the base 3 in a state where the bolts 300 are inserted into the bushes 301.

The O-ring 200 that is used is an elastic member having vibration damping characteristics, for instance made of a fluororesin, and has a shape such that the cross-sectional diameter thereof is large enough to prevent contact between the thread groove spacer 5 and the base 3 during fixing of the thread groove spacer 5 to the base 3. Preferably, the O-ring 200 is formed out of a material that falls under the category "4-D" according to JIS standards.

The bushes 301 are also elastic members having vibration damping characteristics, and are formed, for instance, of nylon.

Thus, the thread groove spacer 5 is fixed to the casing (casing 2, base 3) with an elastic member disposed in between. The method for mounting the thread groove spacer 5 is not limited to the above-described one.

FIGS. 6A and 6B are diagrams illustrating variations of the method for mounting the thread groove spacer 5 in Embodiment 2. In FIGS. 6A and 6B, elements identical to those FIG. 1 and FIG. 4 will be denoted with the same reference numerals, and an explanation thereof will be omitted.

Embodiment 2

Variation 1

As illustrated in FIG. 6A, for instance, a ring groove 201 for fitting and fixing an O-ring 200 may be formed along the circumferential direction of the end face of the base 3, on the inlet port 6 side, and not in the thread groove spacer 5.

The ring grooves 110 (FIG. 4), 201 (FIG. 6) for fitting and fixing the O-ring 200 may be provided on both the thread groove spacer 5 and the end face of the base 3 on the side of the inlet port 6. In this case as well, the O-ring 200 that is used has a shape such that the cross-sectional diameter thereof is large enough to prevent contact between the thread groove spacer 5 and the base 3 during fixing of the thread groove spacer 5 to the base 3.

Embodiment 2

Variation 2

As illustrated in FIG. 6B, for instance, an annular flat plate-like elastic body 202 having vibration damping characteristics may be disposed, instead of the O-ring 200, between the thread groove spacer 5 and the end face of the base 3 on the side of the inlet port 6.

Specifically, the thread groove spacer 5 may be fixed in such a manner that the annular flat plate-like elastic body 202, formed at a position at which the bolt holes 203 for insertion of bolts 300 and the bushes 301 correspond to the four circumferentially equidistant bolt holes 108, is sandwiched between the end face of the base 3 on the side of the inlet port 6, and the face of the mounting section 107 on the side of the outlet port 19.

The explanation of Embodiment 2 and variations thereof described above deals with an instance in which the thread groove spacer 5 is fixed through four bolts 300. However, the number of fixing sites for the bolts 300 is not limited thereto, and need only be at least three sites or more, from the viewpoint of fixing stability. The number of fixing sites of the bolts 300, though, is preferably small, in order to suppress the influence of extraneous vibration that propagates from the casing (casing 2, base 3) to the thread groove spacer 5.

An explanation follows next on the vibration damping characteristic (vibration propagation characteristic) of the elastic member (O-ring 200, elastic body 202) disposed between the thread groove spacer 5 and the casing (casing 2, base 3).

FIG. 7A is a graph illustrating the vibration propagation characteristic of the elastic member.

As illustrated in FIG. 7A, the elastic member has a frequency characteristic of a low-pass filter having a cutoff frequency fc1 (Hz).

That is, the elastic member has a characteristic whereby vibration caused by an shock (disturbance) exerted from outside onto the casing and having a frequency smaller than fc1 (Hz) is not damped, but propagates towards the thread groove spacer 5, while external vibration having a frequency equal to or greater than fc1 (Hz) is damped by 20 dB/decad, and does not propagate readily towards the thread groove spacer 5.

The above-mentioned cutoff frequency of the elastic member takes on a value that is set on the basis of, for instance, the rigidity thereof in a state where the elastic member is disposed between the thread groove spacer 5 and the casing (casing 2, base 3).

An explanation follows next on the contact detection function of the control device 48 of Embodiment 2.

The control device 48 is provided with an A/D conversion circuit, not shown, that converts an analog vibration signal outputted by the vibration sensor 102 into a digital vibration signal.

The control device 48 is also provided with a DSP-based supervisor circuit, not shown, and which receives a vibration signal digitalized by the A/D conversion circuit. The supervisor circuit is programmed so as to detect contact between the rotor portion and the stator portion in the turbo-molecular pump 1'.

Specifically, a digital filter is built into the supervisor circuit, such that a vibration signal of a predetermined pass band frequency is extracted when the digital vibration signal is inputted into the digital filter.

The supervisor circuit is programmed in such a manner that contact between the stator portion and the rotor portion in the turbo-molecular pump 1' is detected to have occurred if the vibration level of the vibration signal having passed through the digital filter (extracted vibration signal) exceeds a predetermined threshold value.

An explanation follows next on the vibration signal damping characteristic of the digital filter in the supervisor circuit.

FIG. 7B is a graph illustrating a vibration signal damping characteristic of the digital filter in the supervisor circuit.

As illustrated in FIG. 7B, the digital filter has a frequency characteristic of a bandpass filter the pass band of which is fc1 to fc2 (Hz).

The digital filter has a characteristic whereby vibration signals having a frequency smaller than fc1 (Hz), and vibration signals having a frequency greater than fc2 (Hz), from among inputted vibration signals, are damped and outputted, i.e. a characteristic whereby only vibration signals between fc1 (Hz) and fc2 (Hz) are outputted.

In Embodiment 2, fc1 (Hz), which denotes the lower limit of the pass band of the digital filter, is set so as to match the cutoff frequency of the above-described elastic member (O-ring 200, elastic body 202) disposed between the thread groove spacer 5 and the casing (casing 2, base 3).

Using thus the digital filter allows damping external vibration that is not damped by the elastic member and that propagates to the thread groove spacer 5, and damping also the resonant vibration component generated upon acceleration and deceleration of the turbo-molecular pump 1'.

The cutoff frequency (fc1) of the elastic member is set to about 100 (Hz) in consideration of the band of resonant vibration that arises upon acceleration and deceleration of the turbo-molecular pump 1'.

In Embodiment 2, thus, the occurrence or not of contact between the stator portion and the rotor portion is determined through comparison of the vibration signal that passes through the digital filter versus a predetermined threshold value.

In Embodiment 2, occurrence or not of contact between the stator portion and the rotor portion is determined on the basis of a vibration signal in a band that contains no (a small) external vibration component, namely a vibration signal of a band unaffected (little affected) by the influence of external vibration, thanks to the action of the elastic member disposed between the thread groove spacer 5 and the casing. In the present embodiment, thus, the occurrence or not of contact between the stator portion and the rotor portion is determined on the basis of vibration signals of a band in which there remains (from which there is extracted) a component of shock or vibration caused by contact between the stator portion and the rotor portion.

Misdetection or the like due to the influence of external vibration can be suppressed thereby, and thus the occurrence or not of contact between the stator portion and the rotor portion can be determined more precisely as a result.

In Embodiment 2, occurrence or not of contact between the stator portion and the rotor portion, i.e., whether the amount of deposited solid product has reached the clearance between the rotor portion and the stator portion, can be detected using a simple configuration such as the above-described one.

In Embodiment 2 a bandpass filter is used as the method for extracting a band in which there remains (from which there is extracted) a component of shock or vibration caused by contact between the stator portion and the rotor portion. Instead of the bandpass filter there can be used a high-pass filter having a cutoff frequency fc1 (Hz) that allows removing at least an external vibration component and a resonant vibration component generated upon acceleration and deceleration of the turbo-molecular pump 1'.

When the control device 48 (supervisor circuit) detects contact between the stator portion and the rotor portion in the turbo-molecular pump 1', the control device 48 issues an alarm signal that denotes an abnormal state.

Upon issuing of the above alarm signal, the turbo-molecular pump 1' of Embodiment 2 automatically stops running, in order to prevent breakage of the parts.

With a view to avoiding the influence of external shocks (perturbations) or misdetection due to noise in the vibration sensor 102, the control device 48 may be provided with a timer function, such that operation of the turbo-molecular pump 1' is stopped when the alarm signal is issued continuously for a time equal to or longer than a predetermined time.

With misdetection of the vibration sensor 102 in mind, the alarm signal may be set to be issued when the time interval (detecting timing interval) at which the above-described vibration is detected (sensed) by the vibration sensor 102 shrinks over time and becomes shorter than a predetermined interval time (period).

Also, the alarm signal may be set to be issued only when the revolutions at which contact is detected exceeds predetermined revolutions (threshold value), or only when an integrated value of the time over which contact is detected exceeds a predetermined time (threshold value). The timing at which an alarm signal is issued is not limited to the above conditions.

For instance, the approach of a maintenance period can be notified in advance through issuing of an alarm signal over a plurality of times (for instance, in two stages), so as to prevent the turbo-molecular pump 1' from becoming unusable all of a sudden.

Specifically, an alarm signal (a contact notification signal) is issued that informs about an early stage of contact between the rotor portion and the stator portion. An alarm signal is issued thereafter that notifies that contact has progressed to a stage at which the turbo-molecular pump 1' is automatically stopped (or stoppage is urged).

The timing at which there are generated such alarm signals denoting level differences in the degree of contact may be set arbitrarily, on the basis of, for instance, the revolutions at which contact is detected, an integrated value of the time over which contact is detected, or variations in the contact detection intervals.

The following intermittent contact phenomena occur until permanent contact is reached:

contact due to solid products→wear at contact portions→temporary non-contact states→progressive deposition of solid product and/or rotor portion deformation (for instance, expansion of the tubular member 29)→permanent contact. Contact sites grow, and the above cycle shortens transiently, as deposition of solid product and deformation of the rotor portion progress as described above.

Therefore, the alarm signal may be issued in accordance with the contact level, while under monitoring of the timing at which the above contact cycle intervals, i.e. contact detection intervals, become transiently shorter.

The operation of the turbo-molecular pump 1' can be stopped at an appropriate period (timing), through issuing of an alarm signal, or of a contact notification signal, in a case where the vibration sensor 102 detects a particular vibration during contact between the rotor portion and the stator portion such as the one described above. This allows forestalling damage (breakage) of the parts of the turbo-molecular pump 1', and allows reducing the running costs of the turbo-molecular pump 1', while increasing safety.

In the above-described Embodiment 2, the sensitivity adjustment device 103 of the vibration sensor 102 is built into the main body of the turbo-molecular pump 1', and thus the sensitivity of the vibration sensor 102 does not have to be adjusted every time. However, the method for doing away with the need for adjusting every time the sensitivity of the vibration sensor 102 is not limited to the above-described one.

For instance, an adjustment value of the detection signal level of the vibration sensor 102 set upon shipment from the factory may be stored in a storage device built into the main body of the turbo-molecular pump 1', instead of building the sensitivity adjustment device 103 into the main body of the turbo-molecular pump 1', such that upon modification of the combination of the control device 48, the control device 48 performs correction by reading, from the storage device, the adjustment value of the detection signal level of the vibration sensor 102. The adjustment value of the detection signal level of the vibration sensor 102 is preferably stored in, for instance, a memory mounted on an in-pump board 104.

Storing thus the adjustment value of detection signal level of the detection signal level of the vibration sensor 102 in a storage device built into the main body of the turbo-molecular pump 1' is more convenient, for instance, in that, as a result, there is no need for adjusting the detection signal level of the vibration sensor 102 every time that the control device 48 is replaced.

In Embodiment 2, the output signal of the vibration sensor 102 is converted to a digital signal. However, the processing method of the output signal of the vibration sensor 102 is not limited thereto. For instance, the process for detecting contact between the rotor portion and the stator portion may be configured so as to use analog signals unconverted to digital signals. In that case, though, an analog filter having the same characteristic as the above-described digital filter is used instead of the latter.

In Embodiment 2 and variations thereof described above there have been explained instances where the vibration sensor 102 for detecting the particular vibration that occurs upon contact between the rotor portion and the stator portion is mounted on a portion at which the rotor portion and the stator portion are likely to come into contact, i.e. a portion in the vicinity of a downstream side (outlet port 19 side) of a gas transfer path at which solid products are likely to deposit.

However, the mounting site of the vibration sensor 102 is not limited to the above-described one. The vibration sensor 102 may be provided at another stator portion that opposes the rotor portion, for instance, on the stator blades 22 or the spacers 23. In this case as well, an elastic member is disposed between the casing and the stator portion at which the vibration sensor 102 is disposed.

What is claimed is:

1. A vacuum pump, comprising:

a casing provided with an inlet port and an outlet port;

a stator portion provided inside the casing;

a rotor portion having a shaft rotatably supported inside the casing, and a rotor disposed on the shaft and provided with a gas transfer mechanism that transfers a gas from the inlet port to the outlet port, the rotor portion being arranged with a predetermined clearance between the rotor portion and the stator portion;

a motor rotating the shaft;

vibration detection means for detecting vibration, disposed in the stator portion, by converting vibration amplitude to an electric signal; and contact detection means for judging an occurrence of contact between the stator portion and the rotor portion when, in the vibration detected by the vibration detection means, an amplitude in frequency of a specific vibration caused by contact between the stator portion and the rotor portion exceeds a predetermined threshold value.

2. The vacuum pump according to claim 1, wherein the specific vibration is a vibration of at least one frequency from among:

a first frequency that denotes a natural frequency of a part configuring the stator portion;

a second frequency that denotes a natural frequency of a part configuring the rotor portion;

a third frequency that denotes a frequency that is a multiple of revolutions (frequency) of the rotor portion;

a fourth frequency that denotes a beat frequency of vibrations of the first through third frequencies; and a fifth frequency, of a specific range, generated upon contact between the rotor portion and the stator portion.

3. The vacuum pump according to claim 1 or 2, wherein the vibration detection means is configured of a vibration sensor disposed in the stator portion, on a member that opposes the rotor portion.

4. The vacuum pump according to claim 1 or 2, wherein the vibration detection means is configured of a plurality of vibration sensors disposed at different location of the stator portion, and detects the occurrence of contact between the stator portion and the rotor portion on the basis of differences in the vibrations detected by the vibration sensors.

5. The vacuum pump according to claim 1 or 2, wherein the stator portion at which the vibration detection means is provided is fixed to the casing through an elastic member.

6. The vacuum pump according to claim 1 or 2, wherein the vibration detection means detects, as vibration, a change over time of a positional displacement of the rotor portion.

7. The vacuum pump according to claim 6, wherein the vibration detection means is configured of a contact-less displacement sensor that detects a displacement of the rotor portion.

8. The vacuum pump according to claim 1 or 2, comprising alarm output means for emitting an alarm for urging execution of maintenance when the contact detection means detects occurrence of contact between the stator portion and the rotor portion.

9. A vacuum pump, comprising:

a casing provided with an inlet port and an outlet port;

a stator portion provided inside the casing;

a rotor portion having a shaft rotatably supported inside the casing, and a rotor disposed on the shaft and provided with a gas transfer mechanism that transfers a gas from the inlet port to the outlet port, the rotor portion being arranged with a predetermined clearance between the rotor portion and the stator portion;

a motor rotating the shaft;

an elastic member having a vibration damping characteristic, disposed between the casing and the stator portion;

vibration detection means disposed on the stator portion;

a filter to which an output of the vibration detection means is inputted, and having, as a pass band, a frequency band higher than a cutoff frequency of the vibration damping characteristic of the elastic member; and contact detection means for detecting an occurrence of contact between the stator portion and the rotor portion when an output of the filter exceeds a predetermined threshold value.

10. The vacuum pump according to claim 9, which is a composite-type vacuum pump comprising a turbo-molecular pump section and a thread groove pump section, wherein the vibration detection means is disposed on a thread groove spacer that forms an evacuation flow path of the thread groove pump section.

11. The vacuum pump according to claim 9 or 10, comprising sensitivity adjustment means, provided on or inside the casing, for adjusting the sensitivity of the vibration detection means.

12. The vacuum pump according to claim 9 or 10, comprising storage means, provided on or inside the casing, for storing a correction value of an output level of the vibration detection means.

13. The vacuum pump according to claim 9 or 10, wherein the elastic member is formed of a material used for O-ring, or formed of an O-ring that is continuous in a circumferential direction.

14. The vacuum pump according to claim 9 or 10, wherein the vibration detection means outputs a digital signal to which a vibration detection value is converted, and the filter is configured of a digital filter.

15. The vacuum pump according to claim 9 or 10, comprising alarm output means for emitting an alarm, or a contact notification signal, urging execution of maintenance when the contact detection means detects occurrence of contact between the stator portion and the rotor portion.

* * * * *